United States Patent [19]

Stemmle

[11] Patent Number: 4,928,128

[45] Date of Patent: May 22, 1990

[54] SHEET CIRCULATION IN A DUPLEX PRINTER

[75] Inventor: Denis J. Stemmle, Webster, N.Y.

[73] Assignee: Xerox Corporation, Stamford, Conn.

[21] Appl. No.: 359,064

[22] Filed: May 30, 1989

[51] Int. Cl.[5] ..... G03G 15/00

[52] U.S. Cl. ..... 346/160; 346/153.1; 355/319; 355/321; 271/186

[58] Field of Search ..... 358/319, 320, 321, 308, 358/309, 311; 346/160, 153.1, 157; 271/186, DIG. 9, 225, 301

[56] References Cited

U.S. PATENT DOCUMENTS

| | | | |
|---|---|---|---|
| 4,110,025 | 8/1978 | Tabata | 355/319 |
| 4,234,180 | 11/1980 | Looney | 271/3.1 |
| 4,272,181 | 6/1981 | Treseder | 355/319 |
| 4,334,765 | 6/1982 | Clark | 355/319 |
| 4,346,880 | 8/1982 | Roller et al. | 271/186 |
| 4,348,101 | 9/1982 | Schonfeld et al. | 355/319 |
| 4,466,733 | 8/1984 | Pels | 355/321 X |
| 4,487,506 | 12/1984 | Repp et al. | 355/318 |
| 4,488,801 | 12/1984 | Gibson | 355/319 |
| 4,553,831 | 11/1985 | Dixon | 355/319 |
| 4,630,921 | 12/1986 | Watanabe | 355/202 |
| 4,692,020 | 9/1987 | Tsujihara | 355/319 |
| 4,699,503 | 10/1987 | Wyltoft | 355/319 |
| 4,708,462 | 11/1987 | Stemmle | 355/319 |
| 4,743,945 | 5/1988 | Ito et al. | 355/319 X |
| 4,745,439 | 5/1988 | Hanada et al. | 355/319 X |
| 4,745,490 | 5/1988 | Shimizu et al. | 346/160 X |
| 4,752,801 | 6/1988 | Kando | 346/160 |
| 4,758,862 | 7/1988 | Fukae et al. | 355/319 |
| 4,769,675 | 9/1988 | Watanabe | 346/157 X |
| 4,772,915 | 9/1988 | Kando | 346/153.1 X |
| 4,780,745 | 10/1988 | Kodama | 355/319 |
| 4,787,616 | 11/1988 | Sasaki et al. | 271/3.1 |
| 4,806,979 | 2/1989 | Tokoro et al. | 355/319 |
| 4,825,245 | 4/1989 | Fukae et al. | 355/319 |
| 4,847,654 | 7/1989 | Honma et al. | 346/160 X |
| 4,853,740 | 8/1989 | Ushio et al. | 355/321 X |

FOREIGN PATENT DOCUMENTS

| | | |
|---|---|---|
| 3113658351 | 12/1982 | Fed. Rep. of Germany . |
| 58-118666A | 7/1983 | Japan . |

*Primary Examiner*—A. C. Prescott

[57] ABSTRACT

In a duplex printer (or copier) 10 with a copy sheet output path 92, and a connecting duplexing path 94 for returning copy sheets to be imaged on their opposite sides, and at least one removable cassette copy sheet tray 70 insertable into an opening in the printer, normally providing for loading copy sheets, the cassette 70 has a top cover member 100 which provides a lower guide member for a substantial portion of the duplexing path 94 for guiding copy sheets over the top of the cassette without restacking therein, and the printer has a fixed baffle arrangement 102 positioned to overly the cover member 100 to provide a mating upper guide member when the cassette 70 is inserted into the printer so that a copy sheet being duplexed is guided between this fixed baffle 102 and the top cover member 100 of the cassette to continue on past the cassette in the duplexing path, but when the cassette is removed, a substantial portion of the duplexing path is opened and exposed for recovering copy sheets therefrom. The duplexing path also includes duplex feed rollers 90 in the printer adjacent the cassette for feeding copy sheets over the top cover member of the cassette without requiring any feeder in the cassette.

6 Claims, 1 Drawing Sheet

SHEET CIRCULATION IN A DUPLEX PRINTER

Figure 1:
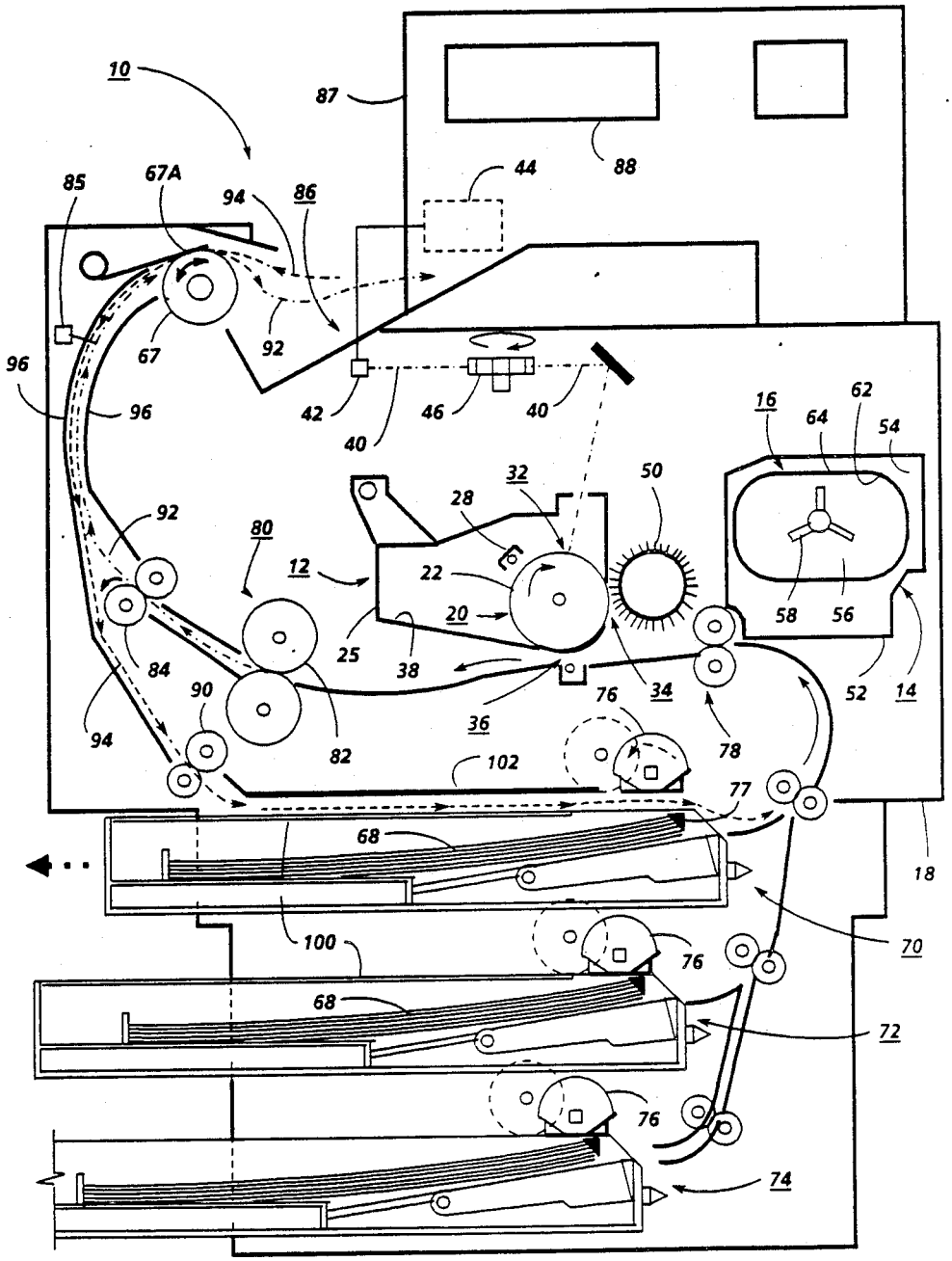

Cross-reference and incorporation by reference is made to a copending application by the same assignee, filed Apr. 20, 1989, as U.S. application No. 07/340,994, by Keith Gilliland, Christian G. Midgley, Francis W. Dana, and Mark C. Mutch, entitled "A MONITOR/-WARRANTY SYSTEM FOR ELECTROSTATOGRAPHIC REPRODUCING MACHINES USING REPLACEABLE CARTRIDGES", Attorney Docket No. D/88373. If any claim may be made the benefit of the priority of filing date thereof it is hereby made.

This invention relates generally to electrostatographic reproducing machines, and more particularly to a simplified duplexing system and path therefore whereby copy sheets may be printed on both sides with little additional machine cost or complexity and with easily accessible sheet transport paths for ease of sheet jam clearance.

There is disclosed herein a simple, low-cost copier or printer duplexing system with a simple but integrated copy sheet output and endless loop duplexing return path.

There is disclosed herein a simple, low cost copier or printer duplexing system providing for closely spaced production of duplex copy sheets without sheet feeding interference in the sheet inverting operation for duplexing.

Various types of duplexing systems are known in the art for copiers and/or printers. The following disclosures are particularly noted as examples, and cite other examples therein. U.S. Pat. No. 4,348,101 issued Sept. 7, 1982 to A. Sconfeld, et al (Sperry Corporation) and U.S. Pat. No. 4,825,245 issued Apr. 25, 1989 to K Fukae et al. (Kentek), shows a duplex printer with partially similar output and inverting paths. Another recent, but less compact, duplexing printer is disclosed in Hitachi U.S. Pat. No. 4,806,979 issued Feb. 21, 1989 to Tokoro et al. Other patent examples of duplexing copiers of interest as showing duplexing paths including reversible sheet output rollers functioning as sheet inverters include Xerox Corporation U.S. Pat. No. 4,708,462 to (the same) D. J. Stemmle issued Nov. 24, 1987 and art cited therein, and Canon U.S. Pat. No. 4,787,616, and Ricoh U.S. Pat. No. 4,692,020. Said U.S. Pat. No. 4,708,462 to D. J. Stemmle is also of interest as disclosing an optional path choice of a trayless duplex loop path extending over and bypassing a duplex buffer tray.

An example of a duplexing copier with a dual mode inverter/output path feeder system, with reversing rolls of interest is in Xerox Corporation U.S. Pat. No. 4,487,506 issued Dec. 11, 1984 to Repp et al.

An inverter per se of interest is disclosed in Xerox Corporation U.S. Pat. No. 4,346,880 issued Aug. 31, 1982 to George J. Roller, et al, wherein part of a preceding inverted sheet can be in the inverter simultanously with (overlapping) the feeding thereinto of the subsequent sheet.

Other art of background interest includes U.S. Pat. No. 4,110,025 issued Aug. 29, 1978 to Tabata; U.S. Pat. No. 4,234,180 issued Nov. 18, 1980 to Looney; U.S. Pat. No. 4,272,181 issued June 9, 1981 to Treseder; U.S. Pat. No. 4,334,765 issued June 15, 1982 to Clark; U.S. 4,348,101 issued Sept. 7, 1982 to Schonfeld et al.; U.S. Pat. No. 4,553,831 issued Nov. 19, 1985 to Dixon; U.S. Pat. No. 4,630,921 issued Dec. 23, 1986 to Watanabe; U.S. Pat. No. 4,699,503 issued Oct. 13, 1987 to Hyltoft; U.S. Pat. No. 4,758,862 issued July 19, 1988; U.S. Pat. No. 4,780,745 issued Oct. 25, 1988 to Kodama; U.S. Pat. No. 4,488,801 issued Dec. 18, 1984 to Gibson; Japanese Patent No. 58-118666(A); German Patent No. 31 13 658.3-51.

A specific feature of the specific embodiment disclosed herein is to provide in a duplex printer or copier with a copy sheet output path, and a connecting duplexing path for returning copy sheets therein to be imaged on their opposite sides to make duplex copies, the improvement wherein:

said duplex printer or copier has at least one removable cassette copy sheet tray insertable into an opening in said duplex printer or copier, said cassette copy sheet tray normally providing for loading copy sheets into the printer, said cassette copy sheet tray having a top cover member adapted to provide a lower guide member for a substantial portion of said duplexing path for guiding copy sheets in said duplexing path over the top of said cassette copy sheet tray without restacking therein, and wherein said duplex printer or copier has a fixed baffle arrangement therein positioned to overly said top cover member of said cassette copy sheet tray when said cassette copy sheet tray is inserted into said duplex printer or copier to provide a mating upper guide member for a substantial portion of said duplexing path, so that when said cassette copy sheet tray is inserted into said duplex printer or copier a copy sheet being duplexed is guided between said fixed baffle arrangement and said top cover member of said cassette copy sheet tray to continue on past said cassette copy sheet tray in said duplexing path, but when said cassette copy sheet tray is removed, said substantial portion of said duplexing path is opened and exposed for recovering copy sheets therefrom.

Further specific features provided by the system disclosed herein, include those wherein said duplexing path includes duplex feed rollers in said duplex printer or copier adjacent one end of said cassette copy sheet tray when said cassette copy sheet tray is inserted in said duplex printer or copier for feeding copy sheets in said duplex path between said fixed baffle arrangement and said top cover member of said cassette copy sheet tray without any feeding means in said cassette copy sheet tray.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus the present invention will be better understood from this description of an embodiment thereof, including the drawing figure (approximately to scale) wherein:

FIG. 1, the Figure, is a schematic side view of one duplex printer embodiment of the system of the invention.

Describing now in further detail the exemplary embodiment with reference to the Figure, there is shown a duplex printer reproducing machine 10 by way of example of an automatic electrostatographic reproducing machine of a type adapted to implement the duplexing system of the present invention. In the example shown, reproducing machine 10 comprises a laser printer, respectively employing three different replaceable xerographic, developer, and toner cartridge units 12, 14, 16 designed to provide a preset number of images in the form of prints or copies. While the machine 10 is exemplified in the ensuing description and the drawing as a printer, other types of reproducing machines such as copiers, ink jet printers, etc., may be envisioned. Although the present system is particularly well adapted for use in automatic electrostatographic reproducing machines, it will be evident from the following description that it is equally well suited for use in a wide variety of copying systems including other electrostatographic systems and is not limited in application to the particular embodiment shown herein.

Xerographic cartridge 12 includes a photoreceptor drum 20, the outer surface 22 of which is coated with a suitable photoconductive material, and a charge corotron 28 for charging the drum photoconductive surface 22 in preparation for imaging. Drum 20 is suitably journaled for rotation within the cartridge body 25, rotating in the direction indicated by the arrow to bring the photoconductive surface 22 thereof past exposure, developer, and transfer stations 32, 34, 36 of machine 10 when cartridge 12 is in the machine 10. To receive xerographic cartridge 12, a suitable cavity 38 is provided in machine frame 18, the cartridge body 25 and cavity 38 having complementary shapes and dimensions such that on insertion of cartridge 12 into cavity 38, drum 20 is in predetermined operating relation with exposure, developer, and transfer stations 32, 34, 36 respectively. With insertion of cartridge 12, drum 20 is drivingly coupled to the conventional drum driving means (not shown) and the electrical connections to cartridge 12 are made.

In the xerographic process practiced, the photoconductive surface 22 of drum 20 is initially uniformly charged by charge corotron 28, following which the charged photoconductive surface 22 is exposed by imaging beam 40 at exposure station 32 to create an electrostatic latent image on the photoconductive surface 22 of drum 20.

Imaging beam 40 is derived from a laser 42 modulated in accordance with image signals from a suitable source 44. Image signal source 44 may comprise any suitable source of image signals such as a memory, document scanner, communication link, tape drive, another computer, etc. The modulated imaging beam 40 output by laser 42 is impinged on the facets of a rotating multifaceted polygon 46 which sweeps the beam across the photoconductive surface 22 of drum 28 at exposure station 32. I.e., a conventional laser printing system is provided.

Following exposure, the electrostatic latent image on the photoconductive surface 22 of drum 20 is developed by a magnetic brush development system contained in developer cartridge 14. The magnetic brush development system includes a suitable magnetic brush roll 50 rotatably journaled in body 52 of cartridge 14, developer being supplied to magnetic brush roll 50 by toner cartridge 16. To receive developer cartridge 14, a suitable cavity 54 is provided in machine frame 18, cartridge body 52 and cavity 54 having complementary shapes and dimensions such that on insertion of cartridge 14 into cavity 54, magnetic brush roll 50 is in predetermined developing relation with the photoconductive surface 22 of drum 20. With insertion of cartridge 14, magnetic brush roll 50 is drivingly coupled to the developer driving means (not shown) in machine 10 and the electrical connections to cartridge are 14 made.

The toner cartridge 16 provides a sump 56 within which developer comprising a predetermined mixture of carrier and toner for the magnetic brush development system in developer cartridge 14 is provided. Alternatively, single component developer may be provided. A rotatable auger 58 mixes the developer in sump 56 and provides developer to magnetic brush roll 50. Magnetic brush roll 50 is suitably journaled for rotation in the body 52 of cartridge 16.

The developer cartridge 14 body 52 forms a cavity 62 for receipt of toner cartridge 16, cavity 62 of cartridge and body 64 of cartridge 16 having complementary shapes and dimensions such that on insertion of cartridge 16 into cavity 62, cartridge 16 is in predetermined operating relation with the magnetic brush roll 50 in developer cartridge 14. With insertion of toner cartridge 16, auger 62 is drivingly coupled to the developer driving means (not shown) and the electrical connections to cartridge 16 made.

Any residual toner particles remaining on the photoconductive surface 22 of drum 20 after transfer are removed by a conventional cleaning mechanism (not shown) in xerographic cartridge 12.

Prints of the images formed on the photoconductive surface of drum 20 are produced by machine 10 on a suitable support material, such as copy sheets 68 or the like. Supplies of stacked copy sheets 68 may be provided in plural paper trays 70, 72, 74. The copy sheets may be of different sizes. The paper trays 70, 72, 74 here are removable and interchangeable cassette units, known per se. Conventionally mounted in the machine 10, to engage the top of the stack of sheets in each tray 70, 72, and 74 when the tray is inserted into the machine 10, are respective conventional sectored or segmented feed rolls 76 for feeding individual sheets seriatum from the stack of sheets in that tray. This sheet feeding is assisted by conventional stack corner snubbers 77 in the trays. Conventional intermittent drives for the feed rolls 76 are illustrated in phantom therewith. Sheets selectively fed on demand from a tray 70, 72, or 74 are all fed to a common registration pinch roll pair 78 in the machine 10 paper path. Following this conventional sheet registration at stalled pinch roll pair 78, the sheet is forwarded on by those rolls to transfer station 36 in proper timed relation with the developed image on drum 20. There, the developed image is transferred to one side (the upper surface) of the copy sheet 68. Following transfer, the copy sheet 68 bearing this toner image is separated from the photoconductive surface 22 of drum 20 and advanced to fixing station 80 where a roll fuser 82 fixed this transferred powder image thereto. After fusing the toner image to the copy sheet 68, the copy sheet 68 is advanced downstream to print discharge rolls 84, which it turn feed the copy sheet downstream towards print output tray 86. A suitable sheet sensor 85 senses each copy sheet as it passes from fixing station 80 to output tray 86. The final discharge of the copy sheet or print to output tray 86 is by elastomer copy sheet output path rollers 67 nipped with a mating spring loaded baffler plate **67*a***.

The duplex printer 10 has a copy sheet output path 92, shown in a dot-dash line with arrows from fuser 80 through output path roller nip 84 rollers on up through curved baffles or chute 96 through copy sheet output path rollers 67 to eject sheets out into output tray 86. Connecting with and utilizing a substantial portion of this output path 92 is a duplexing path 94, shown here in dashed lines and arrows, for returning copy sheets to be imaged on their opposite sides to make duplex copies. This duplexing path 94 includes a copy sheet inverting system provided by reversal of copy sheet output path or ejecting rollers 67. Rollers 67 alternatively eject copy sheets, or with reversal, transport copy sheets into the duplex path 94.

Preferably the distance between output rollers 84 and the reversible ejecting rollers 67 is approximately one half the sheet dimension, in the sheet feeding direction, of the shortest sheet to be duplexed. Thus, for a conventional 11"long letter size sheet 68 fed short edge first this preferable distance between nips 84 and 67 is approximately 7". Thus, the rollers 84 feed copy sheets therefrom downstream through the copy sheet output path 92 to the reversible rollers 67 until about one half extends downstream out of the nip of these output rollers 67, without losing control of the sheet. That is, the chute 96 provides a copy sheet guide path length between said output path roller nip 84 and the reversible copy sheet output path rollers 67 which is a substantial portion of the dimension of the copy sheet being fed, but substantially less than that copy sheet dimension, so that a substantial portion of the copy sheet is extendable through and downstream of the output rollers 67 before the copy sheet is released thereby.

The plane of the nip of the reversible rollers 67 with their engaging surface 67*a*, and the curve of the baffles or chute 96, and the position of the rollers 84, are such that a copy sheet reversibly driven by the reversal of rollers 67 is automatically driven into the duplexing path 94. The chute 96 provides an arcuate copy sheet guide path, against the outside of which a reversed sheet fed back by reversed rollers 67 can uninteruptedly pass by the next sheet, which is moving downstream in the same chute 96 towards rollers 67. Thus, a subsequent copy sheet may be fed downstream (upwardly) in the arcuate copy sheet guide path 96 simultaneously with, for for a substantial time period with, the reverse (downward) feeding of the preceding copy sheet backwards into the duplex path 94, even if the inter-copy gap or pitch space is only about 5 cm.

Sheets 68 reverse fed back into the duplexing path 94 are fed from rollers 67 down through arcuate chute 96 into the nip of duplexing path rollers 90 in the duplexing path. These duplexing path rollers 90 are positioned substantially further in sheet path distance from reversible rollers 67 than are output path rollers 84, and are substantially separated from rollers 84, and rollers 84 have only one opposing pair of rollers, unlike a conventional three or four rollers inverter. With this separate and further downstream path location of duplexing path rollers 90, only that one additional set of rollers 90 is needed for providing duplex path feeding in this system. However, rollers 90 are spaced from rollers 67 by a sheet path distance slightly less than (within) the feeding dimension of the shortest sheet being duplexed, so as to not to release these sheets and to provide positive nip feeding in at least one nip at all times.

As shown by its rotational arrow in the Figure, the outer rollers 84 rotate towards, but are spaced from, the outer wall or baffle of chute 96, thereby helping urge a reverse-fed sheet 68 (from reversed rollers 67) into the duplexing path 94. The (now) lead edge of a reverse driven sheet which might hit this roller 84 is urged to flip over into the duplex path. The duplexing path 94 at that point diverges from the output path 92 and passes by the outside of the rollers 84. This urging of any reverse moving sheet into the duplexing path 94 is also assisted by the curvature of chute 96 and the beam strength of the sheet, which also urges the sheet towards the outside wall of chute 96. However, the chute 96 need not necessarily be arcuate. The outer wall of chute 96 is diverging away from output path 92 and rollers 84 to form the duplex path 94 at that point. Note that no separate inverter chute is required as in most inverter designs. Here there is only one single inverter chute 96 and it is an integral part of the output path, and also of the duplexing path. The sheet reversing for inverting function is integral the normal exit transport in a single paper path. When output of the sheet is desired, rollers 67 simply continue to rotate in the same forward or downstream feeding direction until the sheet is fully ejected, instead of reversing after only about one half of the sheet is extending therefrom.

The long path distance between the nips of rollers 84 and the nips of reversible rollers 67 allows ample time for the reverse feeding of the proceeding sheet out of the nip of rollers 67 into the duplex path 94 before the lead edge of the next copy sheet in the output path 92 reaches the rollers 67 (at which point the rollers 67 must be reversed again to drive that sheet out into tray 86). Thus an expensive high speed or critical reversal system is not required for the rollers 67. Yet the overall path lengths are such that 2, or even 3, sheets can be continuously circulated in the combined output and duplex path loop without pitch skips or copying rate reductions. For duplexing, clean sheets may be alternatingly intermittently fed from any of trays 70–74 to be copied on their first sides alternately and intermixed with the return of those sheets through the duplex path for their second side imaging and outputting into output tray 86.

The forward or ejecting sheet drive velocity of reversible rollers 67 may be about the same as the reverse or duplexing sheet velocty. However, by increasing or decreasing the reverse drive speed and the rollers 90 speed, the duplex path 94 velocity may be changed relative to the simplex or output path speed 92. That allows for a different pitch in the duplex path, e.g., to give a choice of efficient duplex loops for either two or three sheets. (Two sheets requires less page buffer memory) A faster duplex path can return sheets faster to the transfer station for a second side image.

The duplex return rollers 90 feed the sheet being duplexed down onto the top of, and over an upper cover surface 100 of, the uppermost cassette tray 70. The rollers 90 feed the sheet along that tray cover surface 100 to the cassette feeder 76, feeding the sheet under a baffle plate 102 in the machine which is spaced above and parallel to the tray cover surface 70. Thus the feeding baffle or chute for the sheet being duplexed is defined by a fixed upper baffle 102 in the machine 10 and a mating opposing lower baffle 100 which is a part of the removable paper tray cassette 70, and removable therewith.

The duplex return feed rollers 90 are positioned, in the duplex printer (or copier) 10 itself, to be just above cover 100 and upstream of feed rollers 76 when the cassette 70 is inserted into its mating insertion aperture in the printer 10, for feeding copy sheets in the duplex path between the fixed baffle arrangement 102 and the top cover member 100 of cassette copy sheet tray to the other end of the cassette 70 without requiring any transporting or driving means in the cassette 70 itself. Not only is that desirable in itself, but also, when the tray 70 is removed, there is no obstruction to removal or retention of a sheet, which is free to drop by gravity and be both readily visible and removable from that entire substantial portion of the duplexing path through the regular cassette loading aperture. This is true here even if the trail edge of the sheet being removed is still in the nip of rollers 90. That is in contrast to normal sheet jam recovery which normally requires operator opening of machine doors and opening of sheet roller nips.

Note that the paper tray cassette 70 is not being used as a duplex tray here. Here, the cassette tray 70 is only a conventional source of clean or blank copy paper for the first side copying operation, and is not a source of sheets during the duplexing or second side copying operation. Here, the sheets being duplexed (the sheets in the duplex path 94), do not stack or go into the tray 70, they slide over the top of the tray 70 and the stack of clean sheets therein.

The cassette feeder 76 for tray 70 is normally disengaged, as shown, with its open or cut-away roller segments overlying and spaced from the stack of sheets in the tray. Thus, the sheets being duplexed can freely pass under the feeder 76 feed rollers and on to the illustrated sheet feeding rollers carrying the sheets to the registration rollers 78. Then the sheet 68 being duplexed can be imaged on its opposite side at transfer station 36, with the appropriate electronically reordered image, in the same way it was imaged on its first side, and fed to the output tray 86 via output path 92 like a simplex copy sheet, this time without reversing the rollers 67. The sheet being duplexed is turned over, only once, in the natural inversion in the paper path provided between tray 70 and transfer station 36.

If desired, the cassette feeder 76 can be operated or utilized to assist in the duplex path feeding by rotating the feed wheels thereof after the sheet being duplexed has been fed under feeder 76 from rollers 90. The feeder 76 will thus treat the sheet being duplexed as if it were forward feeding an already separated top sheet of the stack of sheets in the tray, sliding that sheet over the top of the stack.

Optionally, fingers (not shown) may be provided over the open or exposed front portion of the top of cassette tray 70, extending between the feed wheels of the feeder 76 (as an extension of the cover 100 in the area where the cover 100 does not extend), to preclude any possibility of the sheet being duplexed from catching on the corner snubbers 77. However, that has not been a problem.

As noted, the use of the upper cover surface 100 of a cassette tray as the lower baffle or sheet guide surface for a major portion of the sheet second pass or duplex path provides a significant advantage, not only in cost and simplicity, but also in jam clearance. Many duplex paths are difficult to clear of paper in the event of a feeding jam. But here, simply by removing the cassette tray 70, as the operator is accustomed to doing anyway for paper loading, that part of the duplex path is fully exposed through the cassette loading entrance, and a jammed sheet therein is removed with the tray. Only one tray 70 is actually needed, but here trays 72 or 74 may be desirably substituted in the top cassette tray location and also provide a duplex path in the same manner, simply by using a standardized cassette upper surface 100 for all cassettes.

To control operation of machine 10, a suitable control panel 87 with various control and print job programming elements is provided. Panel 87 may additionally include a suitable message display window 88 for displaying various operating information to the machine operator. Conventional or readily programmable software microprocessor controls may be used for all machine and paper path operational controls, as is well known in the art.

A simplex-only version of the disclosed printer embodiment has been successfully operating as commercial "Compact Laser Printer" Models 10, 20, 30, and 40, products of Fuji Xerox Corporation, since about Dec. 1987. The present invention adds full duplex capability thereto with only a few dollars in incremental parts costs, since the only parts which need be added for this added function with this system include one more conventional feed roller nip 90 and associated baffling for the duplex return path, plus the clutch or reversing motor for the rollers 67 and, optionally, an additional conventional sheet path sensor. Furthermore, this duplex version provides duplex copies at the same copying rate and with the same small inter-sheet pitch spacing as simplex copies. Conventional paper trays may be utilized, as in these products, or the Fuji Xerox "2970" copier cassettes or many other copier cassettes. No special or dedicated duplex buffer tray or associated extra sheet feeders or separators therefore are required with the present duplexing system.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a duplex printer or copier with a copy sheet output path, and a connecting duplexing path for returning copy sheets therein to be imaged on their opposite sides to make duplex copies, the improvement wherein:

said duplex printer or copier has at least one removable cassette copy sheet tray insertable into an opening in said duplex printer or copier, said cassette copy sheet tray normally providing for loading copy sheets into the printer, said cassette copy sheet tray having a top cover member adapted to provide a lower guide member for a substantial portion of said duplexing path for guiding copy sheets in said duplexing path over the top of said cassette copy sheet tray without restacking therein, and wherein said duplex printer or copier has a fixed baffle arrangement therein positioned to overly said top cover member of said cassette copy sheet tray when said cassette copy sheet tray is inserted into said duplex printer or copier to provide a mating upper guide member for a substantial portion of said duplexing path, so that when said cassette copy sheet tray is inserted into said duplex printer or copier a copy sheet being duplexed is guided between said fixed baffle arrangement and said top cover member of said cassette copy sheet tray to continue on past said cassette copy sheet tray in said duplexing path, but when said cassette copy sheet tray is removed, said substantial portion of said duplexing path is opened and exposed for recovering copy sheets therefrom.

2. The duplex printer or copier of claim 1, wherein said duplexing path includes duplex feed rollers in said duplex printer or copier adjacent said cassette copy sheet tray when said cassette copy sheet tray is inserted in said duplex printer or copier for feeding copy sheets in said duplex path between said fixed baffle arrangement and said top cover member of said cassette copy sheet tray without any feeding means in said cassette copy sheet tray.

3. The duplex printer or copier of claim 1, wherein said printer or copier includes cassettes sheets feeding means normally operated to feed copy sheets from said cassette copy sheet tray when it is inserted, which sheet feeding means are intermittently operated to help transport copy sheets in said duplex path over the top of said cassette copy sheet tray.

4. The duplex printer or copier of claim 3, wherein said sheet feeding means is operated to alternatively feed copy sheets from said same cassette copy sheet tray from a stack of copy sheets therein.

5. The duplex printer or copier of claim 1, wherein there are a plurality of cassette copy sheet trays insertable into said printer or copier at plural locations, in the uppermost of which locations that cassette copy sheet tray so functions as a substantial portion of said duplex path.

6. The duplex printer or copier of claim 5 wherein said plural cassette copy sheet trays interchangeably function in said uppermost location as a substantial portion of said duplex path.

* * * * *